United States Patent [19]

Shindler

[11] 4,023,219

[45] May 17, 1977

[54] NUCLEAR ACCIDENT CARRIER

[75] Inventor: Harry Shindler, Hartford, Conn.

[73] Assignee: Infranor S.A., Switzerland

[22] Filed: Sept. 24, 1973

[21] Appl. No.: 399,715

[30] Foreign Application Priority Data

Sept. 29, 1972 Switzerland ..... 14284/72

[52] U.S. Cl. ..... 5/82 R; 5/92; 312/1; 312/296

[51] Int. Cl.[2] ..... A61G 1/02; A47B 96/00

[58] Field of Search ..... 5/82; 128/912, 134; 24/DIG. 18, 204; 312/1, 296

[56] References Cited

UNITED STATES PATENTS

| | | | |
|---|---|---|---|
| 3,005,673 | 10/1961 | Smith et al. | 312/296 |
| 3,135,972 | 6/1964 | Jakes et al. | 5/82 |
| 3,267,830 | 8/1966 | Van Gaasbeek | 312/1 |
| 3,348,245 | 10/1967 | Shindler | 5/82 |
| 3,474,781 | 10/1969 | Gaylord, Jr. | 128/134 |
| 3,811,139 | 5/1974 | Shaw | 5/82 |

*Primary Examiner*—Casmir A. Nunberg
*Attorney, Agent, or Firm*—Robert E. Burns; Emmanuel J. Lobato; Bruce L. Adams

[57] ABSTRACT

A nuclear accident carrier for conveying an injured contaminated person comprising a portable base into which a stretcher supporting the person can be inserted, and a lid for isolating the person in the base from the outside. The lid is made from a transparent material and is provided along an edge with a sealing strip that, when the carrier is closed, is clamped between the edges of the lid and the base.

8 Claims, 8 Drawing Figures

NUCLEAR ACCIDENT CARRIER

The invention relates to a device for conveying an injured contaminated person, the device having a portable base into which a stretcher for receiving the injured person can be inserted, and a cover which isolates a person in the base from the outside.

Such conveying devices for rescuing persons who have had an accident at a location contaminated by radioactive material are known and may furthermore be fitted with isolating glove-like covers. In this manner an injured person can be isolated and transported from the surroundings to the nearest accident treatment unit or to a hospital and first aid may be provided by means of glove-like sleeves without it being necessary to perform first a decontamination procedure or to open the conveying container. In this manner contamination or the surroundings, for example the ambulance, the medical treatment station and the apparatus thereof, and personnel giving first aid to the injured is avoided. In order that the injured person may remain if necessary for an extended period of time in the isolating conveying devices apparatus is provided for supplying air to the person and filters are provided for the air outlet.

In a known conveying device of this kind the cover consists of a transparent relatively thin and flexible bag of synthetic resin which can be closed by means of a zip fastener. In the rescue of an injured person, this synthetic resin bag must be spread out in an open state on the bottom of the portable base, a stretcher supporting the injured person must be inserted into the base and thereafter the synthetic resin bag must be draped over arcuate supports provided on opposite edges of the base. The bag must then be closed. In this manner the injured person located in the base is completely enclosed, inclusive of the stretcher, in an isolating synthetic resin bag the upper region of which surrounds the base opening like a tent. Manipulation of this flexible synthetic resin bag is however relatively complicated and requires a whole series of time consuming manual operations. Moreover, the relatively thin synthetic resin bag is not very robust because it can be easily perforated or torn by pointed articles. Moreover, there is the disadvantage that the foil constituting the synthetic resin bag frequently exhibits ageing effects and becomes brittle and discoloured after some time. Such conveying devices however must frequently be kept for months or years in a state of readiness in a perfect state if they are to fulfill their purpose when an accident occurs.

The invention is based on the problem of providing a conveying device of the kind referred to above in such manner that an injured contaminated person on a stretcher can be inserted into the base of the conveying device without time consuming prepatory manual operations and the insulating cover can be sealingly attached to the base with a single rapid manipulation. The present invention has as an object the provision of an isolating cover mechanically stable and largely insensitive to damage and ageing effects, and the production of the base and cover in a simple and economical manner.

According to the present invention, there is provided a device for conveying an injured contaminated person, comprising a portable base into which a stretcher supporting the person can be inserted, a rigid lid made from a transparent material, for isolating the person in the base from the outside, and a sealing strip provided along the edges of the lid, the sealing strip being clamped between the edges of the lid and the base when the lid is closed.

In use, after the insertion of the stretcher with the injured person lying thereon into the base the device may be closed by the transparent lid which is preferably produced from a transparent polyvinyl chloride. This can be done by a simple rapidly performed manipulation, the sealing strip ensuring a substantially complete isolation. The cooperating edges of the base and the lid are correspondingly adjusted in respect of their shape during their production.

Preferably the sealing strip is attached along the outer edge of the lid whereas the inner edge of the lid is provided at the level of the sealing strip with a reinforcing rail. The sealing strip is fixed by means extending through the edge of lid and received by the rail. The base is closed by pushing the lid thereinto through a path length which corresponds at least approximately to the width of the sealing strip. It is particularly advantageous when the lid, which consists preferably of one part, is pivotally attached to one long side of the base by means of a hinge.

Although the conveying device according to the invention is suitable for rescuing injured persons who have been exposed to radio-active contamination it can obviously be used also in the case of contamination of other kinds, for example contamination by chemicals.

An embodiment of the invention will now be described by way of example with reference to the accompanying drawings, in which.

Figure 1:
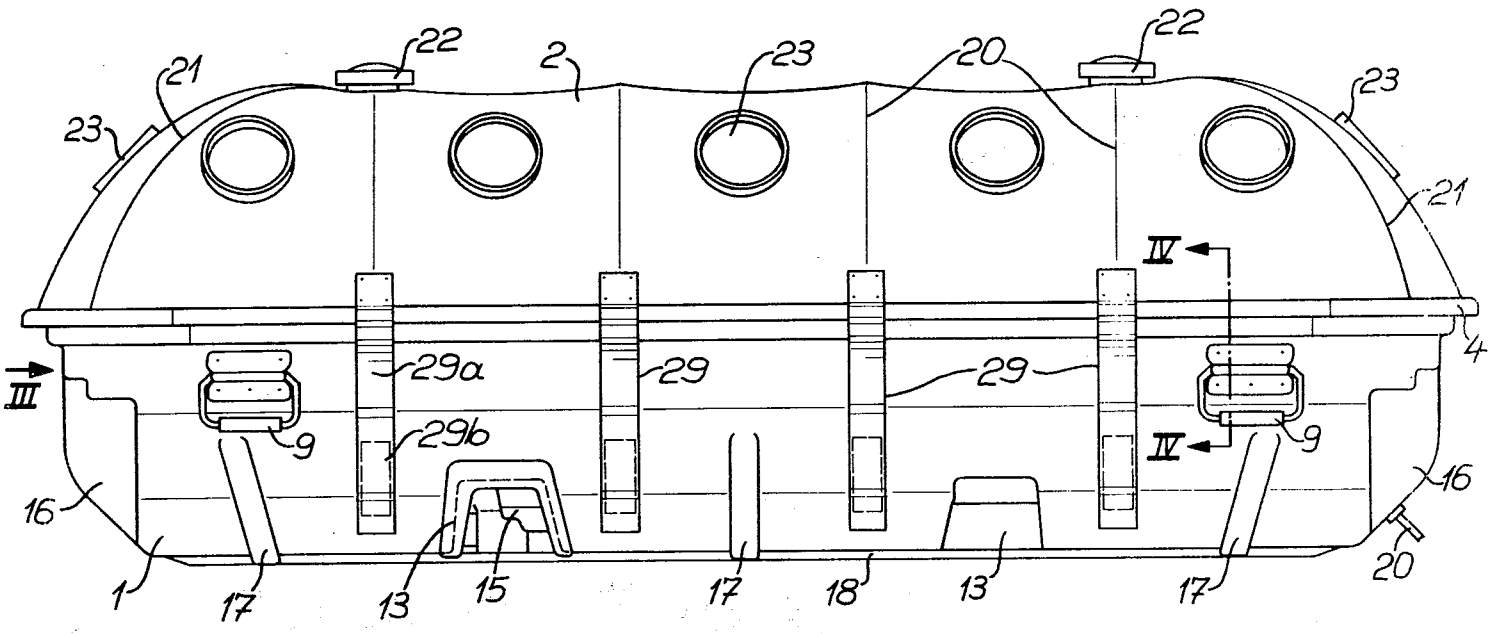
FIG. 1 illustrates a side view of a conveying device according to the invention when closed.
Figure 2:
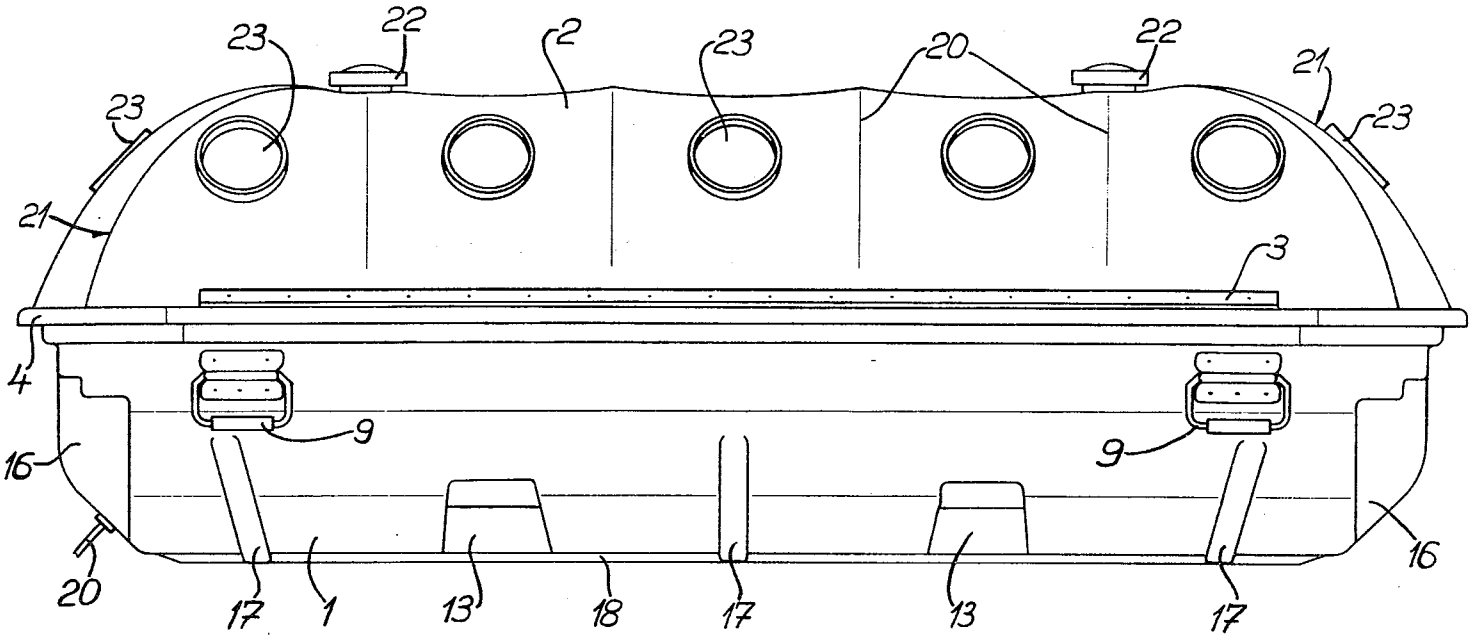
FIG. 2 is a view of the other side of the device shown in FIG. 1.
Figure 3:
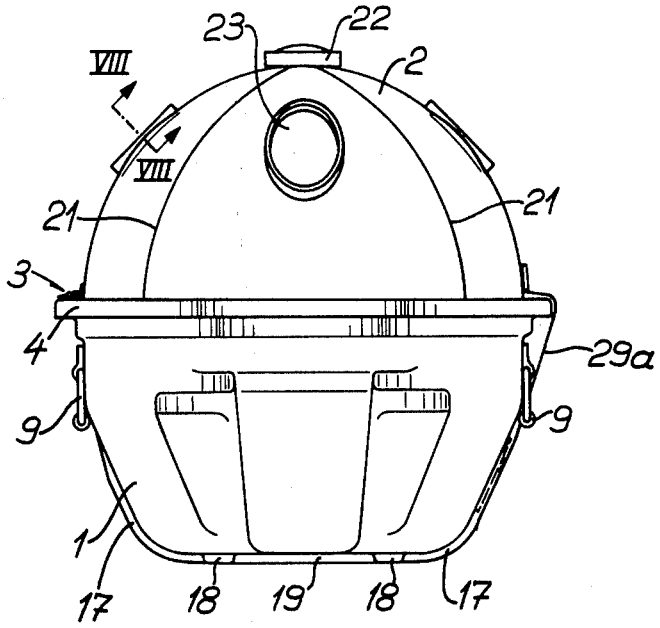
FIG. 3 is a view of the device in the direction of the arrow III in FIG. 1.

Referring to FIGS 1 to 3, the conveying device illustrated comprises a trough-shaped base 1 produced from a synthetic resin material and a curved lid 2 which is produced from a transparent synthetic resin and which is pivotally connected to the one long side of the base 1 by means of a hinge 3. The base 1 and the lid 2 are each constructed in one piece and consist for example of polyvinyl chloride. The base may be opaque and is preferably coloured. The base 1 and the transparent lid 2 each form a stable and substantially rigid component which is largely unaffected by damage and rough handling. The rigid material of the lid 2 can be produced without difficulty in such a manner that it does not exhibit any disadvantageous ageing effects or discolouration even after a long time.

Figure 4:
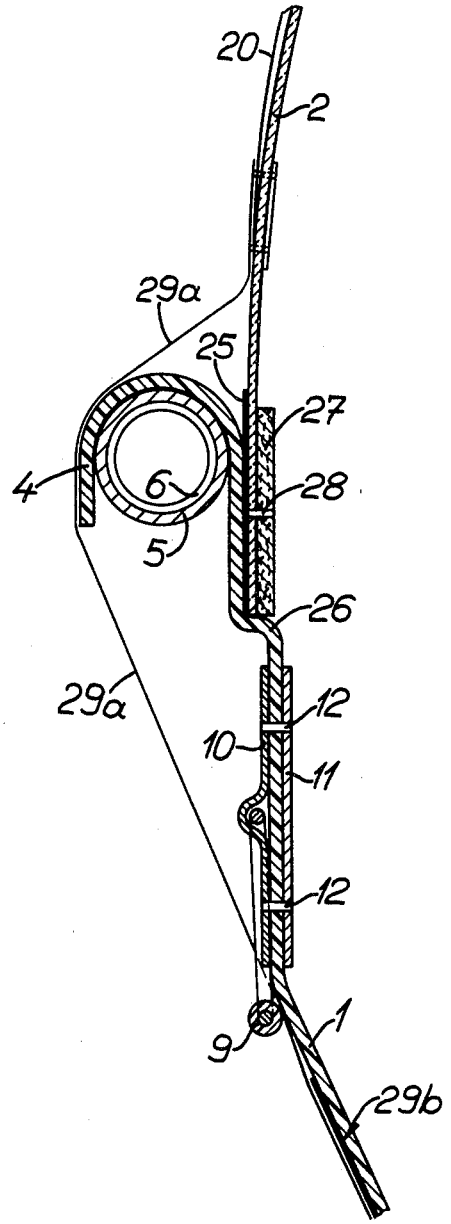
FIG. 4 is a section through the side wall of the lid and the base on the line IV – IV in FIG. 1.
Figure 5:
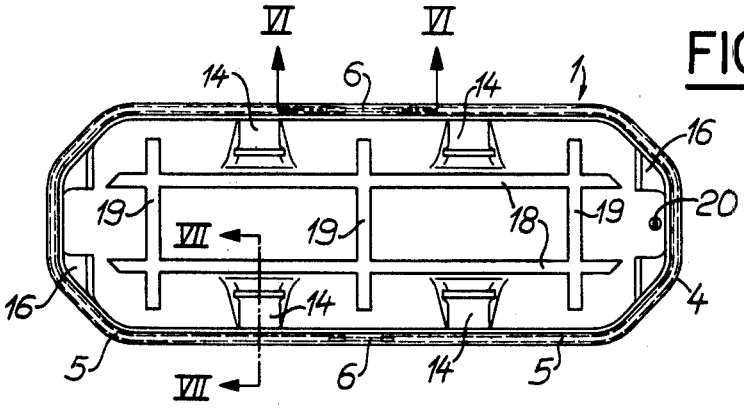
FIG. 5 is a plan view of the open base, the lid not being illustrated.
Figure 6:
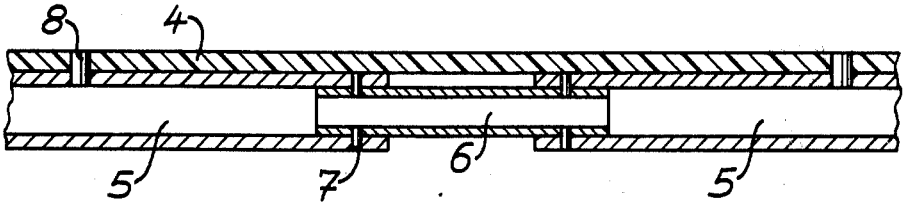
FIG. 6 is a section on the line VI – VI in FIG. 5 through the edge of the base.

The edge 4 of the base 1 is curved outwardly so that it forms in cross section a downwardly open U-shape as shown in FIG. 4. Metal tubes 5 extend around the circumference of the base 1 and serve for stiffening its edge 4. The tubes 5 are inserted into a profile formed on the base edge 4 as illustrated in FIGS. 4 to 6. The metal tubes 5, of which there are two as shown in FIG. 5 each extend along half of the circumference of the base 1 and are connected together by short connecting tubes 6. The connecting tubes 6 engage in the tubes 5 and are fixed thereto by means of rivets 7 (FIG. 6) and the tubes 5 are fixed by means of rivets 8 to the edge 4 of the base 1. Grips 9 attached by pivots 10 to the two long sides of the base 1 facilitate the lifting and carrying of the conveying device. At the level of the pivots 10 of the hand grips 9 a reinforcing rail 11 is attached to the inside of the wall of the base 1 and fixing rivets 12 for the pivots 10 penetrate through the wall of the base and engage the rail 11 (FIG. 4).

Figure 7:
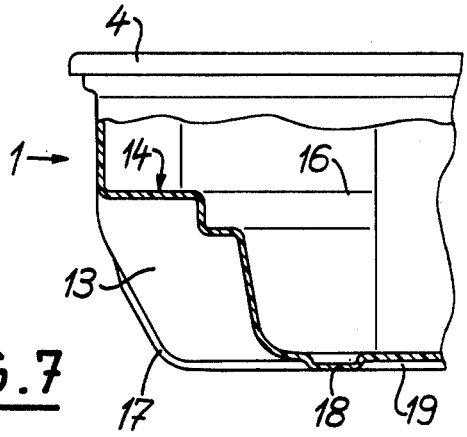
FIG. 7 is a section on the line VII – VII in FIG. 5 through the lateral wall of the base.

The base 1 is provided with various profiled members. Thus each long side of the base 1 is provided in its lower region with two inwardly curved profiled members 13 which form in the interior of the base 1 projections 14 which are disposed in one plane (FIGS. 5 and 7) and each of which moreover has a step as illustrated in FIG. 7. These stepped inner projections 14 serve as a support for a stretcher inserted into the base 1 (not shown) and prevent the stretcher from sliding or wobbling. As diagrammatically illustrated in FIG. 1, a member 15 is formed or attached to one of the profiled regions 13 and permits a connection to be made from the outside to the inside of the closed conveying device for the purpose of supplying fresh air or oxygen and/or a sealed passage of tubes or electrical communication cables so that communication with the injured person from outside is possible. The four flattened corners of the base 1 are also provided with profiled members 16 which project into the interior and the long sides of the base are further provided with three outwardly projecting stiffening ribs 17.

The bottom of the base 1 is provided with two longitudinal and three transverse downwardly projecting ribs 18 and 19 respectively (FIG. 5) which stiffen the bottom of the base 1 and ensure that it rests only on these ribs when on a flat support surface. The transverse ribs 19 preferably merge into the lateral ribs 17.

All the profiled members and ribs described above are formed by a corresponding deformation of the walls or bottom of the base 1.

A closable outlet opening 20 in the form of a synthetic resin outlet tube is provided in the lower region of one narrow side of the base 1 and liquid contamination material can flow or be sucked out therethrough into a container by way of a connecting tube which may be joined thereto. Air escaping from the container or the air coming into contact with the contaminated liquid is purified by means of a filter prior to its escape into the surroundings. Under certain circumstances the contaminated person lying in the base 1 can be decontaminated by spraying with a suitable liquid and thereafter this liquid can be removed through the outlet opening 20.

The curved lid 2, as illustrated in FIGS. 1 to 3, is provided with ribs 20 which are outwardly curved in a slightly convexed manner and directed transversly to the longitudinal direction of the conveying device and with two ribs 21 disposed in the region of each narrow side of the lid 2 which diverge obliquely to both sides. The two last mentioned ribs 21 at each narrow side of the lid converge towards the apex of the adjacent transverse rib 20. An air outlet filter 22 is mounted on the lid 2 on each of the two apex points and these filters remove contamination from air issuing from the closed conveying device.

Figure 8:
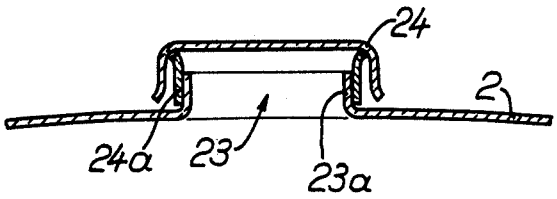
FIG. 8 is a section on the line VIII – VIII in FIG. 3.

Round openings 23 are provided in the lid in the region between the ribs 20 and 21 referred to and these openings can be covered by tightly closing transparent cover caps 24 (FIG. 8) during non-use. According to FIG. 8 the arrangement is made so that each opening 23 is limited by a cylindrical projection **23*a* formed in the lid 2. A sleeve 24*a* is pushed or clamped onto this projection 23*a* and its outer end is overlapped by the cover cap 24 placed thereon for the purpose of a tight, sealing closure. After removal of the cover cap 24 and under certain circumstances of the sleeve 24*a* known glove like sleeves can be inserted as desired into any of the openings 23 in order to give first aid to the person lying in the closed conveying container, the treating person being protected against contamination. Furthermore, a bag-like trap member known per se can be inserted into any one of the openings 23, the trap member being provided in its interior with a space which was closable by two zip fasteners. With the aid of the bag-like member, instruments, food and other articles can be introduced from the outside into the closed conveying container without the supplier coming into contact with the interior of the conveying container. Under certain circumstances air filters may even be inserted into one or more openings 23. All the objects referred to above which can be inserted at choice into the openings 23 can be sealingly attached either to the projection 23*a* or to the sleeve 24*a***.

In the example described ten openings 23 are provided namely four on each long side and one at each narrow side of the lid 2 so that by means of glove-like sleeves first aid can be conveniently applied to the injured at all locations.

As shown in FIG. 4 a sealing strip 25 is attached along the outer edge 4 of the lid 2. The strip 25 extends along the whole periphery of the lid 2 and, as also illustrated in FIG. 4, is clamped between the edge of the lid 2 and the edge 4 of the base 1 when the lid 2 is closed. In this manner a reliable seal and thus isolation is produced automatically when the lid is closed. The peripheral wall of the base 1 forms a step 26 which limited the insertion depth of the lid 2 into the base 1. This insertion depth is approximately as deep as the width of the sealing strip 25. At the level of the sealing strip 25 a reinforcing rail 27 is attached to the inside of the edge of the lid 2. The sealing strip 25 is held in position by fixing pins 28 penetrating the edge of the lid 2 and engaging the rail 27.

The lid 2 may be fixed in the closed position by four adhesive or tear closures 29 which are provided on the long side of the conveying device remote from the hinge 3, as shown in FIG. 1. Each closure 29 may consist of two cooperating synthetic resin strips with filament-like hooks. Such closures are known per se and in general have fine hooks consisting of nylon. One end of one strip **29*a* of each tear closure is attached to the side of the lid 2 whereas the other strip 29*b* is attached for example adhesively to the outside of the wall of the base 1 in the region thereof which is directed obliquely inwardly (FIG. 4). After the lid 2 has been closed it is sufficient to pull the strip 29*a* tightly downwardly over the edge 4 of the trough and to press its free end hard against the strip 29*b* on the wall of the trough whereby the filament-like hooks of both strips inter-engage and form a relatively strong connection. A strongpull on strips 29*a* can rapidly release them again from the strips 29*b*. These adhesion closures 29** therefore constitute an extremely simple yet reliable fixing device for the lid 2 and can moreover be manipulated in an extremely simple and rapid manner completely free of disturbances.

In general a drivable support (not shown) is provided for the conveying device described and the base 1 can be conveyed thereon. For the purpose of treating a person lying in the base 1 the support may be vertically adjustable and pivotal. Pivoting the conveying device on the support is particularly conveninent if contaminated liquid is to be drawn out of the outlet opening 20.

The whole conveying device can be decontaminated in a relatively simple manner with known means after each use and is characterised by cheapness, extreme simplicity and easy, fast handling as well as great stability and strength.

It will be appreciated that a large number of modifications in respect of for example the particular shapes of base and lid, the number and arrangement of the closable openings and the profiled members as well as fixing means for the lid attached to the base may be provided.

What is claimed is:

1. A carrier for transporting an injured contaminated person comprising, a base made as a one-piece lightweight plastic elongated shell open upwardly for receiving a person on a stretcher therein, a lid for hermetically enclosing said person on a litter in said base, said lid comprising a one-piece lightweight plastic elongated shell open downwardly, said base having a peripheral rim extending upwardly and outwardly defining a slightly enlarged peripheral upper marginal portion, said upper marginal portion defining an inner shoulder against which a lower peripheral edge of said lid abuts, said lid having a continuous sealing strip secured outwardly of a peripheral lower marginal portion for abutting against the interior of said upper marginal portion for effecting a hermetic seal therewith when the lid is closed, hinge means for hinging said lid on said base along a longitudinal marginal edge thereof, said lid having a plurality of closable apertures spaced longitudinally thereon each disposed to receive a glove-like sleeve for access into the interior of said lid and said base without opening the lid, and removable covers each removably closing a corresponding one of said apertures.

2. A carrier according to claim 1, in which said rim terminates in an outwardly and downwardly curved edge portion, a reinforcing peripheral metallic tube below said curved edge portion reinforcing said edge portion.

3. A carrier according to claim 2, including a reinforcing band secured to an inner surface of said upper marginal portion.

4. A carrier according to claim 1, including a plurality of adhesive strips removably disposed on a side opposite said hinge means for maintaining said lid attached to said base.

5. A carrier according to claim 1, in which said base has a wall comprising profiled surfaces within said base for providing supports for a stretcher in said base.

6. A carrier according to claim 5, in which said profiled surfaces comprises inwardly directed deformations on said wall of said base.

7. A carrier according to claim 1, including a closable outlet opening in said base for removing contaminated liquids from said base.

8. A carrier according to claim 7, including means comprising an air-filtering outlet in said lid.

* * * * *